United States Patent [19]

Berlage et al.

[11] Patent Number: 4,765,486

[45] Date of Patent: Aug. 23, 1988

[54] METHOD FOR OBTAINING A PURIFIED FRACTION FROM A MIXTURE USING A MAGNETIC FLUID

[75] Inventors: Arnold G. Berlage; Palaniappa Krishnan, both of Corvallis; Douglas M. Bilsland, Junction City; N. Robert Brandenburg, Corvallis, all of Oreg.

[73] Assignees: The United States of America as represented by the Secretary of Agriculture, Washington, D.C.; The State of Oregon, acting by and through the State Board of Higher Education on behalf of Oregon State University, Corvallis, Oreg.

[21] Appl. No.: 506,482

[22] Filed: Jun. 21, 1983 (Under 37 CFR 1.47)

[51] Int. Cl.[4] ..... B03C 1/00

[52] U.S. Cl. ..... 209/8; 209/49; 209/214

[58] Field of Search ..... 209/8, 9, 214, 215, 209/49; 210/695; 426/482, 308

[56] References Cited

U.S. PATENT DOCUMENTS

| | | | |
|---|---|---|---|
| Re. 30,360 | 8/1980 | Shubert | 209/214 |
| 1,832,737 | 11/1931 | Rassi | 426/308 |
| 2,237,442 | 4/1941 | MacFarlane | 426/482 |
| 2,828,010 | 3/1958 | Gompper | 209/8 |
| 3,451,545 | 6/1969 | Studer | 209/8 |
| 3,926,789 | 12/1975 | Shubert | 209/214 |
| 3,929,627 | 12/1975 | Fransiskos et al. | 209/214 |
| 4,223,426 | 4/1980 | Price et al. | 209/214 |

FOREIGN PATENT DOCUMENTS

| | | | |
|---|---|---|---|
| 2800291 | 7/1979 | Fed. Rep. of Germany | 209/8 |
| 819367 | 9/1959 | United Kingdom | 209/8 |

OTHER PUBLICATIONS

Magnetic Fluids, *Chemtech,* Sanas E. Khalafella, Sep. 1975, pp. 540–546.

Technical Bulletin 137, Magnetic Separation of Seeds, Agricultural Experiment Station, Oregon State Univ., May, 1977, Brandenburg.

*Primary Examiner*—Kenneth M. Schor

*Attorney, Agent, or Firm*—M. Howard Silverstein; Margaret A. Connor

[57] ABSTRACT

A method for obtaining a purified fraction from a mixture using a magnetic fluid wherein the mixture is contacted with the magnetic fluid to preferentially sorb the fluid onto selected components so they become magnetized and the magnetic components in the so-contacted mixture are separated from the nonmagnetic components by passing the mixture through a magnetic field. The method finds particular use for obtaining a purified sample of crop seed from a mixture of crop seed and soil of the same size and texture and for separating nut shells from nutmeats.

1 Claim, 1 Drawing Sheet

METHOD FOR OBTAINING A PURIFIED FRACTION FROM A MIXTURE USING A MAGNETIC FLUID

BACKGROUND OF THE INVENTION

This invention relates to a novel method for obtaining a purified fraction from a mixture using a magnetic fluid. The invention finds particular use for obtaining a purified fraction of crop seed.

The seed crop as it comes from the field contains a variety of contaminants such as weed seeds, soil particles, and inert material. These contaminants must be removed after harvest to obtain pure, live, crop for replanting. Tolerance limits for these contaminants vary from state to state and are usually more restrictive for the export market. For example, in order to minimize the spread of soil-borne pathogens, the amount of soil in crop seed for export to Japan cannot exceed 0.03 percent by weight. Some other countries have even more restrictive limits.

Conventional methods of cleaning crop seed include separation procedures based on differences in the physical properties of the crop seed and the contaminants, such as size, weight, color, density or a combination thereof. Seed processors also use magnetic cleaning to separate seeds and contaminants having different surface textures, such as smooth crop seed from rough or sticky contaminants. In this process, the seed mixture is moistened, iron powder added and the mixture mixed. Contaminants which are rough in texture or sticky tend to pick up the powder whereas smooth seed does not. The mixture is then passed over a magnetic separator which separates the magnetized contaminants from the nonmagnetized seeds.

While the above techniques are useful where physical differences are sufficient for separation, when the crop seed and contaminants are the same size and texture, restrictive phytosanitary tolerances for export of crop seed cannot be met by the conventional methods.

SUMMARY OF THE INVENTION

We have discovered a novel method for obtaining a purified fraction from a mixture using a magnetic fluid. In our method, the mixture is contacted with the magnetic fluid to preferentially sorb the fluid onto selected components of the mixture so that they become magnetized. Then, the mixture is passed through a magnetic field to separate the magnetized components from the nonmagnetized components.

This invention finds particular use for obtaining purified fractions of crop seed. Using this method, crop seed mixed with soil which has approximately the same size and texture as the soil and which cannot be purified by conventional cleaning procedures can now be purified so as to meet strict phytosanitary tolerances for export.

The invention also finds use for separating nutmeats from the outer shell of nuts to obtain a purified nutmeat fraction.

Other objects and advantages of the invention will become readily apparent from the ensuing description.

DETAILED DESCRIPTION OF THE INVENTION

Figure 1:
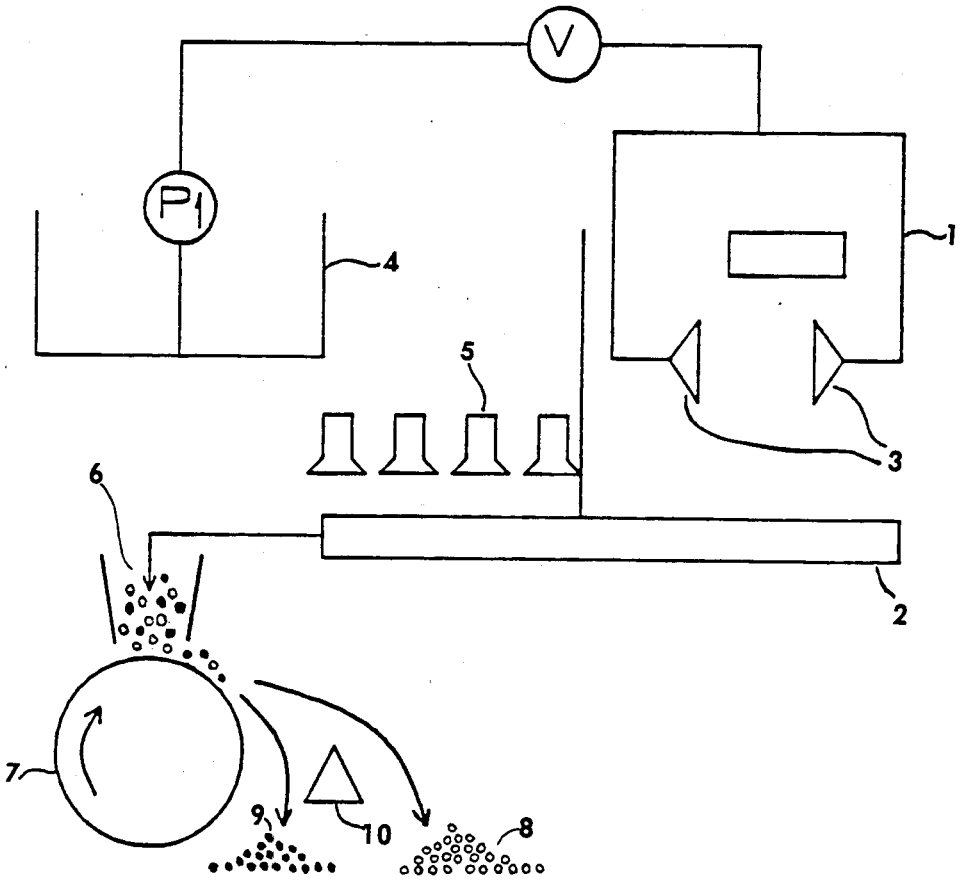
FIG. 1 is a schematic diagram illustrating the continuous separation embodiment of the invention.

In the first step of the method of the invention, the mixture is contacted with a magnetic fluid to preferentially sorb the fluid onto selected components of the mixture so that they become magnetized such that upon passage of the mixture through a magnetic field, the components having fluid sorbed thereon (magnetized components) are separated from the other components in the mixture (nonmagnetized components).

The term "mixture" includes any composition containing two or more components. It may be one in which the components are intermingled such as a mixture of crop seed and soil or may be one in which the components are located at separate areas in the mixture such as a whole nut comprising an outer shell and an inner nutmeat.

The term "sorption" is used generically to include adsorption, that is, the phenomenon where the fluid adheres to the surface of the components; absorption, that is, where the fluid permeates the pores of the components; or both adsorption and absorption.

Magnetic fluids are defined as Newtonian liquids that retain their fluidity in the presence of an external magnetic field. They comprise stable colloidal suspensions of magnetic particles in liquid carriers such as water, hydrocarbons (kerosine, heptane), fluorocarbons, and silicones. Ferromagnetic liquids, commonly known as "ferrofluids" comprise magnetic colloids in which the dispersed phase is a magnetic ferrous material. These fluids may also contain ferromagnetic particles other than iron, namely cobalt, nickel, gadolinium, and dysprosium, hence the general term "magnetic fluids."

Magnetic fluids, like other colloids, are prepared from magnetic matter by dispersing the bulk state or by agglomerating the molecular state until the desired size of the colloidal particle is reached. U.S. Pat. No. 3,764,540 (Khalafalla et al.), which is hereby incorporated by reference, discloses a method for preparing magnetic fluids comprising a stable, colloidal suspension of magnetite and elemental iron. Magnetic fluids are also available commercially.

The contacting step can be carried out in several ways such as by mixing the mixture with the magnetic fluid, immersing the mixture in the fluid, spraying the fluid onto the mixture, and the like. The critical feature of the contacting step is that the fluid is preferentially sorbed by selected components of the mixture so that they become magnetized such that upon passage of the so-contacted mixture through a magnetic field, the magnetized components separate from the nonmagnetized components. Where the mixture is one in which the components are intermingled, preferential sorption of the fluid may be due to the differing porosity of the components with the selected components sorbing the fluid in preference to the other components in the mixture. Where the mixture is a whole nut or the like, the fluid is preferentially sorbed onto one component (the outer shell) and not the other (nutmeat) due to the contacting of the shell (selected component) and not the nutmeat with the fluid.

Optimum concentration of magnetic fluid varies depending on the mixture being separated. Optimum concentration is determined by trial runs at varying concentrations to determine the one at which the desired separation is achieved. It is within the compass of the invention to use wetting or sticking agents or adhesives in the contacting step to enhance the preferential sorption of the magnetic fluid by the selected components.

Subsequent to the contacting step, the mixture is passed through a magnetic field to separate the magnetized components from the nonmagnetized ones to obtain a purified fraction. The magnetic field may be produced by a permanent magnet, by an electromagnet, and the like. Types of magnetic separators include magnetic drum separators and magnetic belt separators. Other types of magnetic separators will be obvious to those in the art. The contacted mixture may be passed through the magnetic field one or more times as needed to achieve the desired separation.

The method of the invention may be carried out as a continuous or batch process as described in detail below. The magnetic fluid can be recovered and recycled for subsequent runs.

In one embodiment of the invention, prior to the separation step, the contacted mixture is treated so that the magnetized and nonmagnetized components will separate when passed through the magnetic field. A preferred treatment method is drying of the contacted mixture so that it flows freely. Where the magnetized and nonmagnetized components remain agglomerated after drying, a further step such as agitating or comminuting the dried mixture is included.

In the case where the whole nut is contacted with magnetic fluid, the shell is cracked into pieces prior to the separation step. A drying step prior to cracking can also be included.

Using the method of the invention, smooth crop seed and soil mixtures having the same size and texture, for example, bentgrass seed and soil, which could not be separated by other procedures can be purified to obtain a fraction which meets the phytosanitary tolerance limit of 0.03 percent by weight of soil.

Other examples of mixtures from which a purified fraction may be obtained by this method include mixtures of grass, vegetable, fruit, legume, and flower crop seeds and soil; onion seeds and white caps; cracked tree seeds and whole (uncracked) tree seeds; immature onion seeds and mature onion seeds; rind or pulp pieces and vegetable or fruit seeds; and nut shells and nutmeats.

The following examples are given to further illustrate the invention and are not intended to limit the scope of the invention which is defined by the claims.

EXAMPLE 1

In the following example, a mixture of bentgrass seed and soil obtained by a commercial cleaning procedure was treated by the method of the invention to obtain a purified crop seed fraction. The conventional cleaning procedure included debearding, air screening, and gravity table separation, however, the "cleaned" mixture still greatly exceeded the phytosanitary limit of 0.03 percent by weight of soil. The approximate average particle size of the mixture was about 0.2 to 0.5 mm and the particles had a smooth surface. The magnetic fluid used was an aqueous colloidal suspension of a ferromagnetic iron lignosulfonate wherein the lignosulfonate molecules were chemically bonded to the magnetite particle such that separation of the magnetite from lignosulfonate and loss of magnetic properties did not occur if the fluid was dried and redissolved. The magnetite particles averaged 100 angstroms in diameter with an approximate range of 50 to 200 angstroms. The fluid had an iron content of 10.27 percent and a total solids content of 32 percent, by weight. (This solution is sold under the tradename "Lignosite" FML by the Georgia-Pacific Corporation).

Three different dilutions of the magnetic fluid (15:1, 10:1, and 5:1 water to fluid ratio by volume) were used. These dilutions had 0.54, 0.77, and 1.70 percent iron, by weight, and 1.70, 2.40, and 5.30 percent total solids, respectively.

The test procedure was as follows: a 50-gram sample of the bentgrass seed-soil mixture was placed in a glass jar and 4 ml of the magnetic fluid of a given dilution (15:1, 10:1, or 5:1) was injected into it in a random manner. Each sample was mixed in a laboratory batch-type mixer for 20 minutes. A wooden-spiked stirrer in the jar enhanced the mixing action. During this contacting step, the magnetic fluid was preferentially sorbed by the soil particles. The so-contacted mixture was spread out on a shallow tray and dried until the mixture was free flowing (overnight at room temperature (21° C.)). This drying step caused the mixture to have the property of ready separation of nonmagnetized components from the magnetized components when it was passed through a magnetic field.

Next, the dried mixture was passed over a laboratory electromagnetic drum separator at a given field intensity setting (800, 2750, 4400, or 6250 gauss) to separate the magnetized components from the nonmagnetized ones. A single pass over the separator was used for each test run. The feed rate, drum speed, and divider setting were held constant at 1.2 gm/sec, the equivalent of 40 rpm for a 25 cm drum, and 40/64, respectively, for all runs. Each test was replicated twice.

The magnetized fraction held by the magnetic drum and the nonmagnetized fraction of each test run were weighed. Soil examination test for the purified seed (nonmagnetic) fraction and the untreated control seed samples were carried out according to the "Rules for Testing Seeds," *Journal of Seed Technology*, Association of Official Seed Analysts, Volume 3, Number 3 (1978). Two replicates of the control had 0.32 and 0.27 percent soil particles by weight. The percentages of soil particles in the purified seed fraction from the test runs are shown in Table 1.

As can be seen from the results in Table 1, the soil content was reduced significantly in each test run. The magnetic intensity of the electromagnetic separator significantly ($P=0.01$) affected the weight percentages of soil particles in the purified fractions from the separation runs. When the separator was operated at high intensities (6250 gauss), more soil particles were removed, leaving a smaller portion or soil particles (0.01–0.03%) in the purified fractions. Conversely, when the separator was operated at low intensities (800 gauss), fewer soil particles were removed leaving a relatively larger portion of soil particles (0.04–0.13%) in the purified fractions. Within the range tested, the effect of fluid dilution was insignificant when the variation in percentages of soil particles due to chance was considered and the interaction effect between magnetic intensity of the separator and fluid dilution also was insignificant, which means that the effect of magnetic intensity was not dependent on fluid dilution for the presence of soil particles in the purified fractions.

TABLE 1

SOIL PARTICLES IN THE PURIFIED SEED FRACTIONS*

| Magnetic fluid dilution | Magnetic intensity in gauss 800 | 2750 | 4400 | 6250 |
|---|---|---|---|---|
| | Soil particles (% by weight) | | | |
| 15:1** | 0.13 | 0.05 | 0.04 | 0.01 |
| | 0.08 | 0.04 | 0.04 | 0.03 |
| 10:1 | 0.08 | 0.04 | 0.02 | 0.03 |
| | 0.08 | 0.04 | 0.02 | 0.02 |
| 5:1 | 0.04 | 0.04 | 0.05 | 0.02 |
| | 0.07 | 0.07 | 0.04 | 0.03 |

*Two replicates of the control had 0.32 and 0.27 percent soil particles by weight.
**Parts of water to parts of magnetic fluid, by volume.

The weight percent of the magnetized fractions of the initial mixture for each dilution level and magnetic intensity is given in Table 2. This fraction increased as the magnetic intensity and fluid concentration increased. Using a 10:1 dilution and 4400 gauss, 74% of the original mixture met the phytosanitary tolerance levels for soil particles for export to Japan. The remaining fraction can be sold at usual market prices in the United States where there are no phytosanitary restrictions regarding soil particles. At a magnetic fluid dilution of 5:1 and a magnetic intensity of 6250 gauss, the purified fraction (41% of the initial mixture) met the phytosanitary restrictions for export. The remaining fraction contained approximately 0.6% soil particles by weight and was suitable for sale as crop seed in the United States.

TABLE 2

WEIGHT PERCENT OF MAGNETIZED FRACTIONS

| Magnetic fluid dilution | Magnetic intensity in gauss 800 | 2750 | 4400 | 6250 |
|---|---|---|---|---|
| | Magnetized fractions (weight % of the starting mixture) | | | |
| 15:1* | 2.18 | 6.76 | 14.66 | 34.40 |
| | 2.34 | 12.66 | 15.38 | 27.64 |
| 10:1 | 2.54 | 10.92 | 26.38 | 34.00 |
| | 3.04 | 17.24 | 26.18 | 29.84 |
| 5:1 | 6.58 | 36.22 | 63.16 | 59.12 |
| | 5.84 | 37.82 | 66.14 | 58.54 |

*Parts of water to parts of magnetic fluid, by volume.

Germination tests were also carried out on samples treated with 5.1 fluid dilution (but not processed through the magnetic separator), purified fractions obtained by treatment with the 5.1 fluid and processing through the magnetic separator at 6250 gauss), and untreated control seed samples. The results are shown in Table 3.

TABLE 3

GERMINATION TEST DATA* OF THE BENTGRASS SEEDSOIL MIXTURE SAMPLES

| Treatment conditions: 5:1 diluted fluid (before processing)** NG*** | AG*** | 5:1 diluted fluid (after processing)** NG | AG | Control (untreated)** NG | AG |
|---|---|---|---|---|---|
| 91 | 5 | 94 | 0 | 94 | 3 |
| 92 | 4 | 93 | 3 | 92 | 4 |

*Each value of the germination percentage is the mean of 3 replicates.
**Before processing - seed contaminant mixture was treated with the (5:1 diluted) magnetic fluid but was not processed through the electromagnetic separator.
After processing - the seed contaminant mixture was treated with the 5:1 diluted magnetic fluid and processed through the electromagnetic separator at the 6250 gauss setting. The purified fraction was used in the germination tests.
Untreated - the control (original sample) was not treated with the 5:1 diluted magnetic fluid. It also was not processed through the electromagnetic separator.
***NG - normal germination.
AG - abnormal germination.

EXAMPLE 2

The following example illustrates a continuous process for obtaining a purified seed fraction.

A mixture of bentgrass seed and soil particles obtained after bentgrass seed from the field was cleaned commercially as described in Example 1 was fed by a electromagnetic feeder (1) in a vertical stream at a rate of approximately 26 gm/sec to a vibrator conveyor (2) 163 cm long. The feeder was positioned 58 cm above the conveyor. Two Teejet flat spray nozzles (3) located on either side of the seed-soil mixture stream and 25 cm above the conveyor sprayed magnetic fluid (4) from the magnetic fluid reservoir of the type described in Example 1 (diluted 10 parts water to 1 part magnetic fluid) on the mixture at a rate sufficient to thoroughly wet the mixture. The treated seed-soil mixture was dried by four infrared lamps (5) located 10 cm above the conveyor so the mixture flowed freely before it was collected at the conveyor discharge end. The dried sample (6) was then passed over a permanent magnetic drum separator (7) (600–800 gauss) two times, thereby separating the mixture into a purified seed fraction (8) and a soil fraction (9). The feed rate, drum speed, and divider (10) setting were held constant at 1.2 gm/sec, 40 rpm for a 25 cm drum, and 40/64, respectively. Soil examination tests of the purified fraction and untreated control seed samples were carried out as described in Example 1. The soil content of the initial mixture was 1.28 percent. After treatment by the method of the invention, the soil content in the purified seed fraction was 0.02 percent.

EXAMPLE 3

In the following example, results obtained by the method of the invention are compared to results achieved using the conventional magnetic separation method with iron powder.

Onto a 50-gram sample of bentgrass seed and soil obtained after cleaning by a commercial process as described in Example 1 was sprayed 20 ml of magnetic fluid of the type described in Example 1 (diluted 1 part fluid to 10 parts water). The mixture was mixed 20 minutes and dried overnight at room temperature. The dried mixture was passed two times over a laboratory sized magnetic drum separator to obtain a purified seed fraction. Subsamples of the original mixture and the purified fraction were examined under the microscope and the soil clods counted. Two replicate samples of the original mixture contained 89 and 99 clods per 2-gram sample. Two replicate samples of the purified fraction contained 2 and 4 clods per 2-gram samples.

In the following comparison procedure using iron powder, a 50-gram sample of the soil-seed mixture was moistened with 0.6 gm moisture and 1 gram of iron powder added and the mixture mixed well. The mixture was passed over a magnetic drum separator and the clods of the purified fraction counted as described above. A total of 58 and 81 clods per 2-gram replicate samples were counted.

EXAMPLE 4

The following is an example wherein nut shells are separated from nutmeats to obtain a purified nutmeat fraction.

Two samples, one of large walnuts and one of small walnuts, were treated by the following procedure: a 600-gram sample of whole walnuts (42 big walnuts or 52 small walnuts) were fully immersed in the concentrated magnetic fluid described in Example 1 so that the fluid contacted the entire nut surface. The mixture was dried in a flat pan overnight at room temperature and the nuts cracked into pieces. The dried mixture of cracked nuts was passed once over a permanent magnetic drum separator to separate the magnetized shells from the non-magnetized nutmeats. No shell fragments were found in the small walnut sample. Three walnut shell pieces were found in the large walnut shell fraction.

Having thus described our invention, we claim:

1. A method for obtaining a purified fraction of bentgrass seed from a mixture containing bentgrass seed and soil particles, which comprises:

(a) contacting the mixture with aqueous magnetic fluid to sorb the fluid onto the soil particles in preference to the bentgrass seed so that the soil particles become magnetized in preference to the bentgrass seed;

(b) drying the so-contacted mixture; and (c) separating the preferentially magnetized soil particles from the bentgrass seed in the mixture by passing the dried mixture through a magnetic field.

* * * * *